US006520221B2

(12) United States Patent
Gatteschi

(10) Patent No.: US 6,520,221 B2
(45) Date of Patent: Feb. 18, 2003

(54) FILLING NOZZLE WITH INTERCEPTION OF SUPPLY LIQUIDS FOR FILLING MACHINES

(75) Inventor: Emanuele Gatteschi, Parma (IT)

(73) Assignee: OCME S.r.l., Parma (IT)

( * ) Notice: Subject to any disclaimer, the term of this patent is extended or adjusted under 35 U.S.C. 154(b) by 0 days.

(21) Appl. No.: 09/790,206

(22) Filed: Feb. 21, 2001

(65) Prior Publication Data

US 2002/0005226 A1 Jan. 17, 2002

(30) Foreign Application Priority Data

Feb. 24, 2000 (IT) ..... MI00A0338

(51) Int. Cl.[7] ..... B65B 3/04; B67C 3/00

(52) U.S. Cl. ..... 141/285; 141/127; 141/351; 141/360; 141/362; 222/334; 222/503

(58) Field of Search ..... 141/57, 285, 360, 141/361, 362, 351, 126, 127; 222/440, 442, 445, 447, 448, 450, 503, 333, 334

(56) References Cited

U.S. PATENT DOCUMENTS 2,652,965 A * 9/1953 McGihon ..... 141/360
2,663,479 A * 12/1953 Detrez ..... 141/360
2,770,404 A 11/1956 Galloway
2,820,579 A * 1/1958 Roth ..... 222/440
2,847,145 A 8/1958 Brasile et al.
4,210,262 A * 7/1980 Donaldson ..... 222/442
4,832,096 A 5/1989 Kohlbach

FOREIGN PATENT DOCUMENTS

| | | |
|---|---|---|
| DE | 19 58 477 | 4/1971 |
| EP | 0 770 574 | 5/1997 |
| FR | 2 164 014 | 7/1973 |
| FR | 2 389 538 | 12/1978 |

* cited by examiner

*Primary Examiner*—Timothy L. Maust
(74) *Attorney, Agent, or Firm*—Hedman & Costigan, P.C.

(57) ABSTRACT

A filling nozzle with interception of supply liquids for filling machines, alignable with a container to be filled by liquid, comprising a shutter member (21) and an opening (18) in a hollow body (16), wherein the hollow body (16) is associated on the upper side with a supply system (12) for a liquid to be delivered into the container, the hollow body (16) being displaceable at least between an engaging position, wherein its opening (18) is closed by the shutter member (21), and a disengaging position, wherein the opening (21) is open and the liquid flows into the container, control members (33, 35, 36) being provided for the displacement of the hollow body (16).

9 Claims, 3 Drawing Sheets

FILLING NOZZLE WITH INTERCEPTION OF SUPPLY LIQUIDS FOR FILLING MACHINES

The present invention relates to a filling nozzle with interception of supply liquids for filling machines. In the field of machines for filling containers with liquids, in the filling head and particularly in the nozzle, devices are provided which are able to stop or intercept the liquid flow when the metering head is not filling. Arrangements are also provided such as to control the liquid flow during the filling.

To date, these tasks are usually achieved by providing a spear valve which, upon insertion into the outlet hole of the nozzle, stops the liquid flow. Furthermore, the spear valve, by moving away from the hole, frees the passage and accordingly allows the liquid outflow with as higher a flow rate (under the same conditions) as farther the tip moves away from the hole.

In these nozzles, there is an outer portion, generally stationary with respect to the supply system of the machine, which has the hole for the liquid outflow, and a shutter, movable by means of a stem, which controls and intercepts the flow upon insertion into said hole. Thus, there is a control stem, immersed into the liquid to be metered, which results in pressure drops, thereby decreasing the achievable flow rate in that it occupies a certain section of the nozzle body.

For control purposes, a complicated arrangement of parts must be provided, able to determine the movement of the stem passing through the nozzle body and the supply system and coming out on the top in order to be controlled by suitable actuators.

This arrangement of parts results in the same contacting the product, and, as required, their complete washing must be provided during the washing cycle of the interior of the filling machine. Thus, the operation of the nozzle is mechanically complex, with related washing and maintenance problems. The object of the present invention is that of providing a filling nozzle with interception of supply liquids for filling machines which solves the aforementioned technical problems.

Another object is that of simplifying the devices related to the interception and to the control of the same.

A further object is that of facilitating and improving the washing and cleaning operations.

These and other objects according to the present invention are achieved by providing a filling nozzle with interception of supply liquids for filling machines according to claim 1.

The features and advantages of a filling nozzle with interception of supply liquids for filling machines according to the present invention will be more evident from the following description, by way of example and not of limitation, with reference to the appended schematic drawings, wherein.

Figure 1:
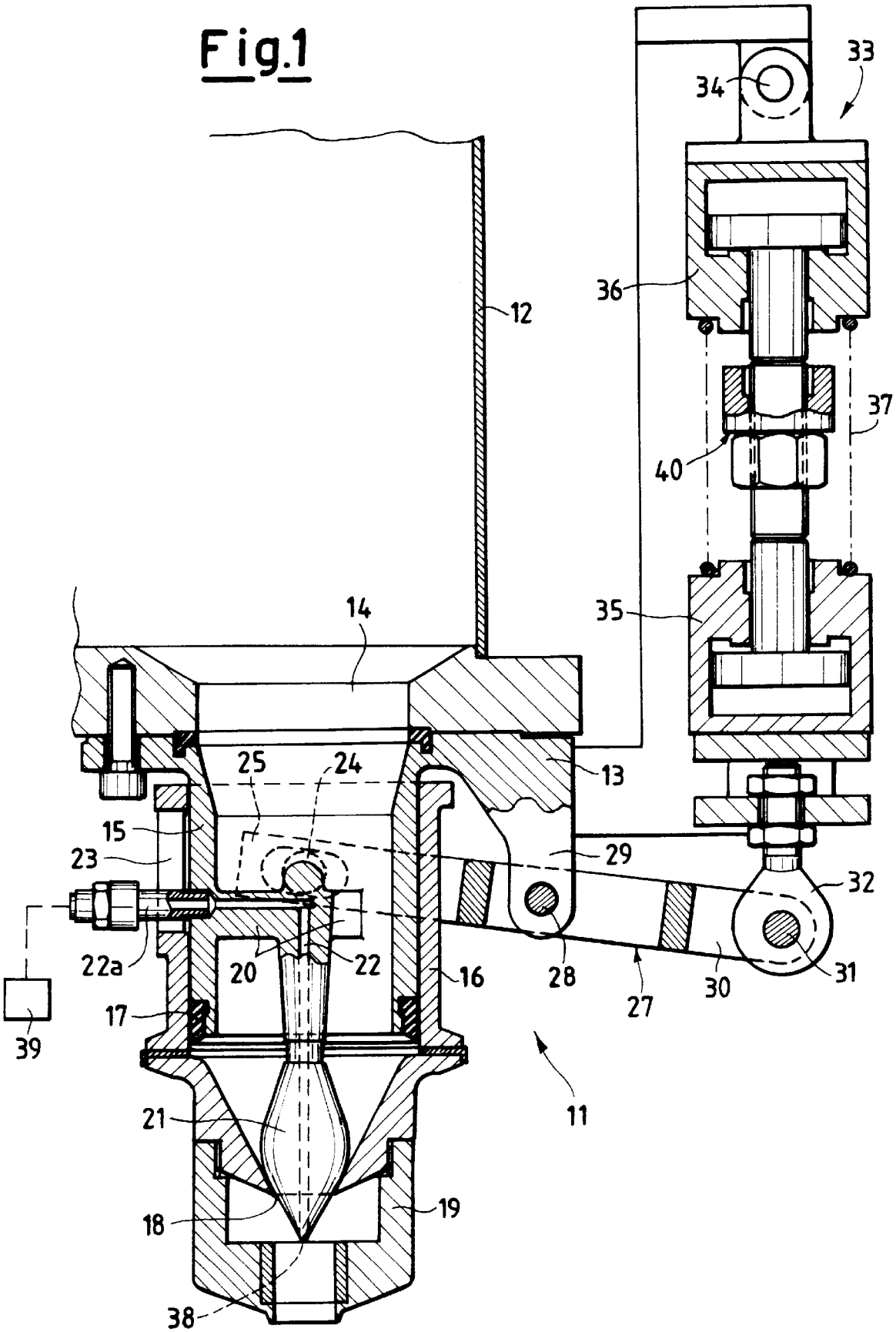
FIG. 1 is a partial cross-sectional view of a filling nozzle with interception of supply liquids for filling machines, in a closed position.

By referring to the Figures, there is shown a filling nozzle with interception of supply liquids for filling machines, referred to in its whole as 11 and associated with a supply system 12 for a liquid. Nozzle 11 may be arranged on a filling machine of a stationary or rotating type alone or in a plurality of similar units. Supply system 12, e.g. a reservoir, is located above a supporting structure 13 carrying the nozzle 11. A bottom opening 14 of the supply system 12 is aligned with a tubular mouthpiece 15, provided in the supporting structure 13 and facing downwards so as to be inserted into a sleeve or hollow body 16 forming the outer portion of the nozzle 11.

Hollow body 16 is also tubular and able to, at least partially, sealingly surround the mouthpiece 15 via a gasket 17, arranged outside the mouthpiece 15 and slidable onto the hollow body 16. The presence of the gasket ensures the sealing against the liquid leakage, even if the supply system 12 of the machine is pressurized.

Hollow body 16 has, on the bottom side thereof, a discharging mouthpiece or outlet opening 18 for the liquid, which may receive additional systems for conveying and slowing down the fluid, such as screens or the like, generally shown in Figure by the reference number 19, e.g. screwed onto the hollow body 16.

A shutter member 21, e.g. nose-shaped, is integral with the mouthpiece 15 and the supporting structure 13 and is supported by a rod 20, radially facing towards the interior of the mouthpiece 15. For example, such a rod 20 might be a tongue out of three tongues arranged at 120° and supporting the shutter member.

Within said rod 20 and within the shutter member 21 a passage 22 may be provided both for the suction of a last drop of filling liquid and for blowing inert gas or introducing a second liquid into the container (not shown). Such a passage 22, outwardly shaped as a tubing 22*a*, further passes inside a slot 23 vertically provided onto the side surface of the hollow body 16. According to the present invention, hollow body 16 is displaceable at least between an engaging position, wherein the opening 18 is engaged and closed by the shutter member 21, and a disengaging position, wherein the liquid flows from such an opening 18, more or less large, into the container (not shown).

For such a movement, outside the hollow body 16, onto pivots 24, there are provided slotted ends 25 of a pair of arms (only partially shown in the Figures) of a control fork 27.

Control fork 27 is centrally swiveled at 28 onto a downward extension 29 of the supporting structure 13 and extends on the other side into a second fork end 30 (partially shown) This second end 30 is bound via a pin 31 to an end eyelet 32 of an actuating member or assembly, referred to in its whole with numeral 33.

Actuating member 33 is, at its other end, bound via a further pin 34 to the supporting structure 13. Actuating member 33 includes, in the example shown, a pair of pneumatic cylinders 35 e 36, whose travel, whether indepedent or combined, allows to achieve up to three different opening degrees for the nozzle. Thereby it is possibile to achieve the rough-filling of the container, by means of the two cylinders 35 and 36, simultaneaously actuated, and the finishing filling, only by means of the cylinder 36.

Figure 2:
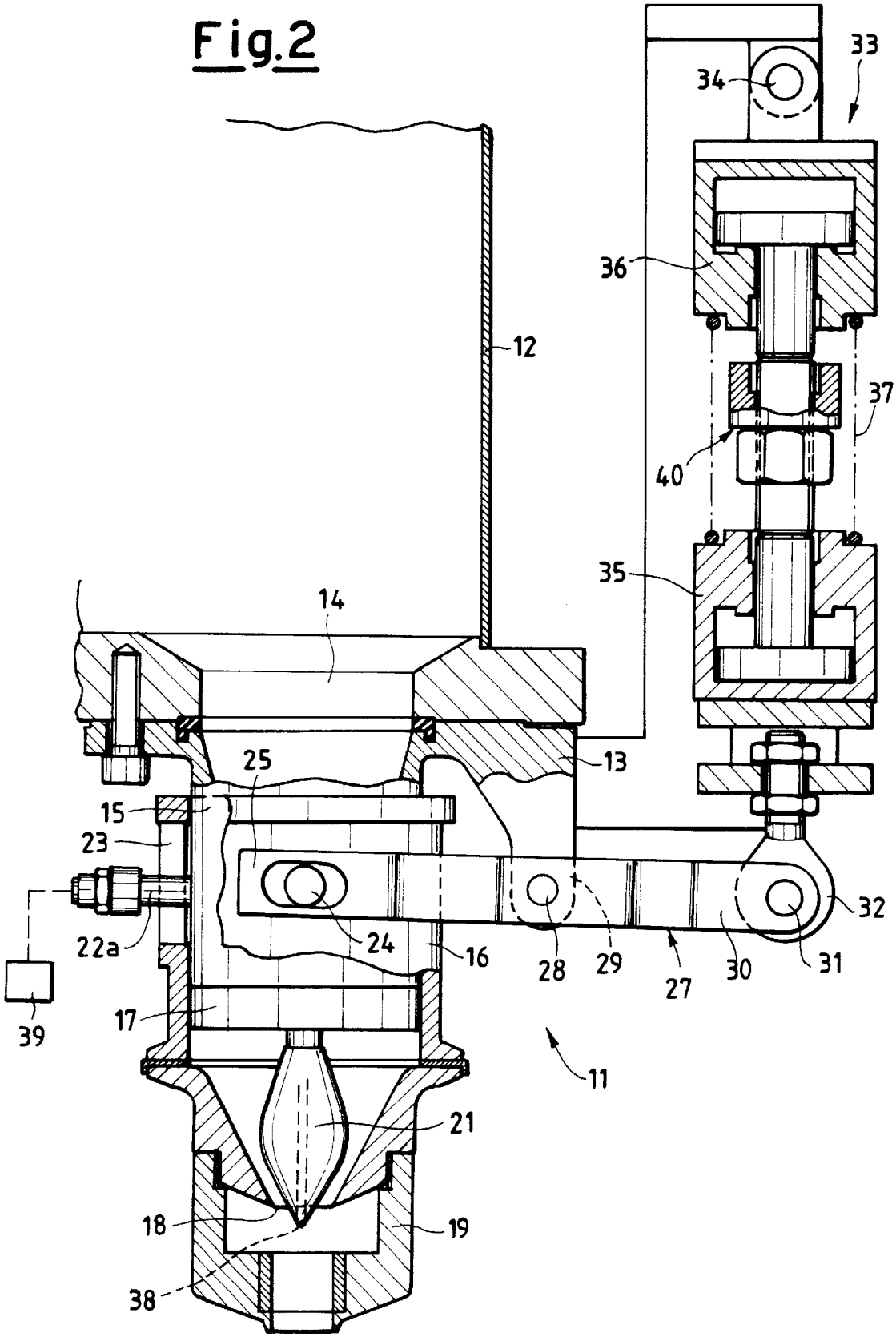
FIG. 2 is a cross-sectional view similar to the one in FIG. 1, in an intermediate opening position of the nozzle.
Figure 3:
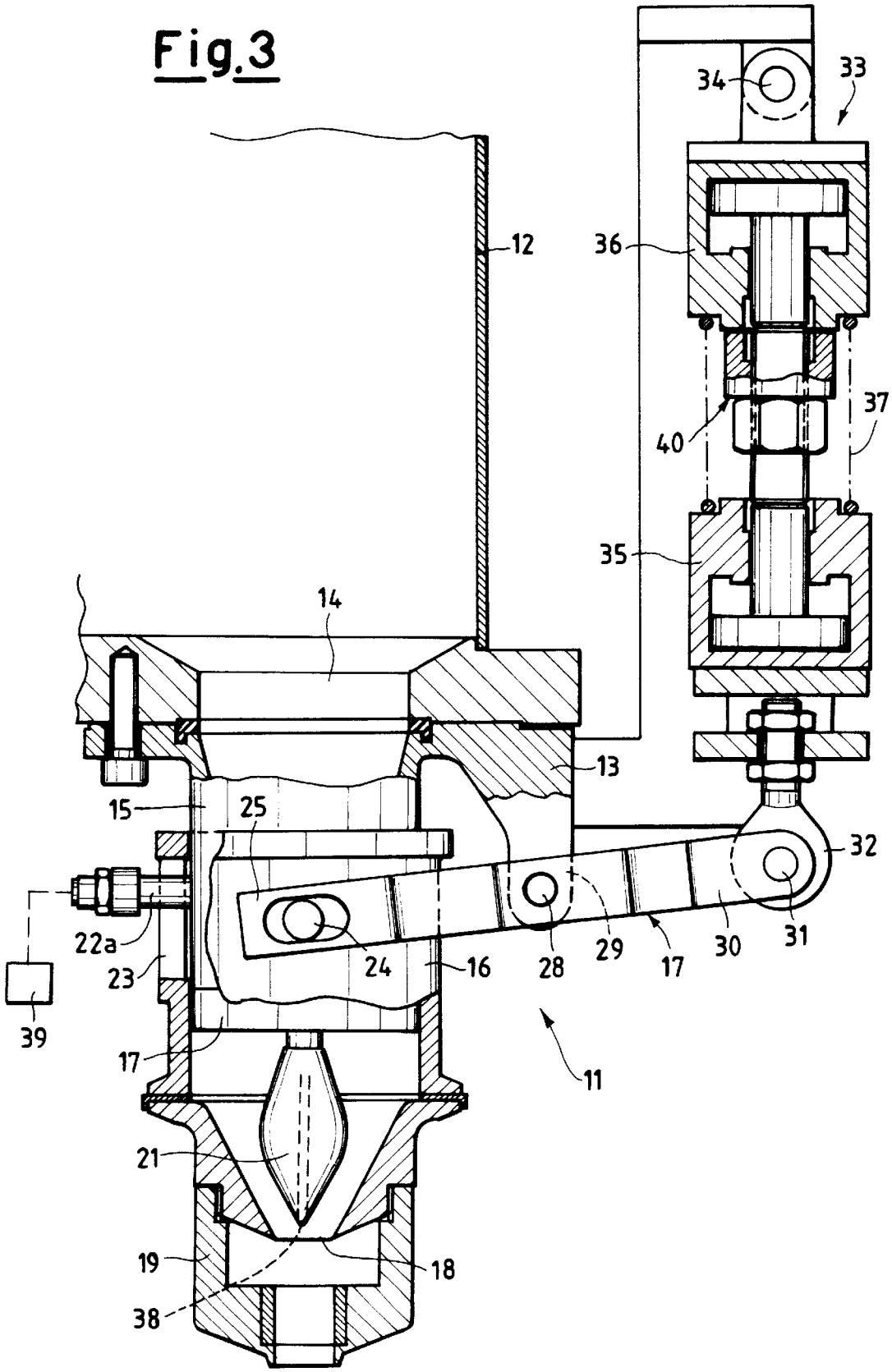
FIG. 3 is a cross-sectional view similar to the one in FIG. 1, in a maximum opening position of the nozzle.

In fact, starting from the position in FIG. 1, wherein the nozzle is closed by the shutter member 21, the actuation of both cylinders 35 and 36 allows to supply as much liquid as possible into the container with rough-filling, as shown in FIG. 3. The return of a cylinder, i.e. the one referred to with numeral 35, allows to achieve a reduced passage for the finishing filling of the container, as shown in FIG. 2. The return of the two cylinders 35 and 36 to the position shown in FIG. 1 closes again the nozzle upon the filling of the container.

Anyhow, such an actuating member 33 may be likewise comprised of an electric unit with brushless motor, stepper motor or other device. Thereby a nozzle opening is achieved which may be set at will between a complete closure and a complete opening, instead of the only three levels achievable by means of the aforementioned pneumatic cylinders.

In the example shown, with pneumatic actuators, there is provided a safety spring 37 which acts as to close the nozzle in case of lack of compressed air. In such a case, spring 37 overcomes the liquid pressure, the weight of the devices and the friction, thereby achieving the closure of the nozzle. On the contrary, during the normal filling, the force of the cylinders 35 and 36 must be obviously sufficient to overcome the force exerted by the safety spring 37. A screw control device with nut and check nut is provided, designed as 40, arranged between the two cylinders 35 and 36 and able to effect a reduction of the travel of cylinder 36.

When using electric actuators, the closing of the nozzle must be achieved in case of lack of electric power: to that end, capacitors or batteries are used which provide a sufficient energy to effect the operation.

Thus, it may be seen that, in the nozzle according to the present invention, the opening and closing of the flow is achieved by moving the outer portion or hollow body 16 of the nozzle and keeping the tip or shutter member 21 stationary, unlike what occurred in prior nozzles. Obviously, by the term "stationary" it is meant that the shutter member 21 is integral with the supply system 12 or the structure 13 of the machine, even in case of rotation about its axis by a filling machine of a rotating type.

According to the present invention, a nozzle is thus comprised of an inner portion 21, stationary with respect to the supply system 12 of the machine and acting as a shutter, as well as of an outer portion 16, movable with respect thereto and carrying the hole 18 for the passage of the liquid to be metered.

The presence of the gasket 17, interposed between the stationary inner portion 21 and the movable outer portion 16, is such to ensure the sealing against the liquid leakage, even if the supply system of the machine is pressurized.

During the opening of the nozzle, the mouthpiece 18 for the liquid outflow is not stationary, but is moving with respect to the supply system 12 and to the container to be filled (not shown) for as higher an extent as larger the opening achieved by the nozzle.

In the case of a spear valve 21, the discharging or outlet mouthpiece 18, possibily with the additional member 19, approaches the mouth of the container during the opening of the nozzle and moves away therefrom in the closing.

According to the invention, the nozzle may be actuated by suitable devices without a control stem be present, which is immersed into the liquid to be metered, as is the case with prior nozzles. The absence of the stem increases the section of the liquid passage, thereby decreasing the pressure drops in passing through the nozzle and increasing the achievable flow rate (under the same conditions). The absence of the stem also results in less parts contacting the product, thereby achieving a better washability inside the machine.

Finally, according to the invention the movement of the nozzle is mechanically more simple and convenient: actuators 35 and 36 are on the side of the nozzle, whilst in prior the stem of the same shutter extended until it came out on the top of the supply system, where the actuators were arranged. Furthermore, this moving arrangement of the nozzle on the side thereof makes all the maintenance and adjustment operations of the same far easier.

From the Figures it shall be noted how, when the movable outer portion 16 is in the uppermost position, the tip of the shutter 21 closes the discharging mouthpiece 18 and stops the liquid flow.

The provision of a passage 22 within the nozzle allows the suction of liquid drops, which otherwise may soil the containers at the end of the filling. Such a suction is carried out by means of a hole 38 provided onto the tip of the shutter 21 and connected, via the passage 22 and the tubing 22*a*, to a system for the suction and filtering of air, schematically shown in 39.

In other cases, the hole 38, provided onto the tip to the shutter 21, may be used for introducing specific gases or liquids inside the product being metered (e.g. inert gases or products to be mixed upon the filling), supplied from a source also designed as 39. In fact, there are cases wherein two different liquids must be introduced into the same container: in such cases one of the liquids coming from two different reservoirs may be passed inside the hollow body 16 of the nozzle and the other through the hole 38 on the tip of the shutter 21, connected to the passage 22.

The advantages of a nozzle according to the present invention are therefore evident.

What is claimed is:

1. A filling nozzle with interception of supply liquids for filling machines, alignable with a container to be filled by a liquid, characterized in that it includes a shutter member (21) and an opening (18) in a hollow body (16), wherein said hollow body (16) is associated, on an upper side, with a supply system (12) for a liquid to be delivered into said container, said hollow body (16) being displaced at least between an engaging position, wherein said opening (18) is closed by said shutter member (21), and a disengaging position, wherein said opening (18) is disengaging from said shutter member (21), and the liquid flows into said container, control members (33, 35, 36) being provided for the displacement of said hollow body (16) wherein said hollow body (16) is carried through pins (24) of a control fork (27), centrally swiveled (at 28) to said supporting structure (13) and journaled (at 31) at the other end to said control members (33, 35, 36), wherein said shutter member (21) has a passage (22) provided therein for the blowing or suction, connected to a suitable source (39).

2. A filling nozzle according to claim 1, characterized in that said passage (22) extends into a tubing (22*a*) located within a slot (23) laterally provided onto said hollow body (16).

3. A filling nozzle according to claim 1, characterized in that said external source is a supply system (39) of a second liquid.

4. A filling nozzle according to claim 1, characterized in that said external source is a blowing unit (39) of a gas.

5. A filling nozzle according to claim 1, characterized in that said external source is a suction unit for a filling liquid.

6. A filling nozzle, with interception of supply liquids for filling machines, alignable with a container to be filled by a liquid, characterized in that it includes a shutter member (21) and an opening (18) in a hollow body (16), wherein said hollow body (16) is associated, on an upper side, with a supply system (12) for a liquid to be delivered into said container, said hollow body (16) being displaced at least between an engaging position, wherein said opening (18) is closed by said shutter member (21), and a disengaging position, wherein said opening (18) is disengaging from said shutter member (21), and the liquid flows into said container, control members (33, 35, 36) being provided for the displacement of said hollow body (16) wherein said hollow body (16) is carried through pins (24) of a control fork (27), centrally swiveled (at 28) to said supporting structure (13) and journaled (at 31) at the other end to said control members (33, 35, 36), wherein said control members (33)

comprise a pair of pneumatic cylinders (35, 36) whose travel, whether independent or combined, allows to achieve up to three different opening degrees of said nozzle.

7. A filling nozzle with interception of supply liquids for filling machines, alignable with a container to be filled by a liquid, characterized in that it includes a shutter member (21) and an opening (18) in a hollow body (16), wherein said hollow body (16) is associated, on an upper side, with a supply system (12) for a liquid to be delivered into said container, said hollow body (16) being displaced at least between an engaging position, wherein said opening (18) is closed by said shutter member (21), and a disengaging position, wherein said opening (18) is disengaging from said shutter member (21), and the liquid flows into said container, control members (33, 35, 36) being provided for the displacement of said hollow body (16) wherein said hollow body (16) is carried through pins (24) of a control fork (27), centrally swiveled (at 28) to said supporting structure (13) and journaled (at 31) at the other end to said control members (33, 35, 36), wherein said filling nozzle further comprises a screw control device with a nut and check nut (40), arranged between a pair of pneumatic cylinders (35, 36), and able to effect a reduction of the travel of the cylinder (36).

8. A filling nozzle with interception of supply liquids for filling machines, alignable with a container to be filled by a liquid, characterized in that it includes a shutter member (21) and an opening (18) in a hollow body (16), wherein said hollow body (16) is associated, on an upper side, with a supply system (12) for a liquid to be delivered into said container, said hollow body (16) being displaced at least between an engaging position, wherein said opening (18) is closed by said shutter member (21), and a disengaging position, wherein said opening (18) is disengaging from said shutter member (21), and the liquid flows into said container, control members (33, 35, 36) being provided for the displacement of said hollow body (16) wherein said hollow body (16) is carried through pins (24) of a control fork (27), centrally swiveled (at 28) to said supporting structure (13) and journaled (at 31) at the other end to said control members (33, 35, 36), wherein between a pair of pneumatic cylinders (35, 36), a safety spring (37) is provided which, at rest, causes the displacement of said hollow body (16) onto said shutter member (21).

9. A filling nozzle with interception of supply liquids for filling machines, alignable with a container to be filled by a liquid, characterized in that it includes a shutter member (21) and an opening (18) in a hollow body (16), wherein said hollow body (16) is associated, on an upper side, with a supply system (12) for a liquid to be delivered into said container, said hollow body (16) being displaced at least between an engaging position, wherein said opening (18) is closed by said shutter member (21), and a disengaging position, wherein said opening (18) is disengaging from said shutter member (21), and the liquid flows into said container, control members (33, 35, 36) being provided for the displacement of said hollow body (16) wherein said hollow body (16) is carried through pins (24) of a control fork (27), centrally swiveled (at 28) to said supporting structure (13) and journaled (at 31) at the other end to said control members (33, 35, 36), wherein a gasket (17), slidable onto said hollow body (16), is arranged between said hollow body (16) and a mouthpiece (15) extending from a bottom opening (14) of said supply system (12).

* * * * *